US008979088B2

(12) United States Patent
Itabashi

(10) Patent No.: US 8,979,088 B2
(45) Date of Patent: Mar. 17, 2015

(54) SHEET FEEDING APPARATUS AND IMAGE FORMING APPARATUS

(71) Applicant: Canon Kabushiki Kaisha, Tokyo (JP)

(72) Inventor: Toshifumi Itabashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/056,141

(22) Filed: Oct. 17, 2013

(65) Prior Publication Data

US 2014/0125002 A1 May 8, 2014

(30) Foreign Application Priority Data

Nov. 2, 2012 (JP) ..... 2012-242698

(51) Int. Cl.

| | |
|---|---|
| ***B65H 3/52*** | (2006.01) |
| ***B65H 7/00*** | (2006.01) |
| ***B65H 3/06*** | (2006.01) |
| ***B65H 5/06*** | (2006.01) |

(52) U.S. Cl.

CPC ..... *B65H 7/00* (2013.01); *B65H 3/0676* (2013.01); *B65H 3/0684* (2013.01); *B65H 5/068* (2013.01)

USPC ..... 271/125; 271/124; 271/122; 271/10.04

(58) Field of Classification Search

USPC ..... 271/122, 124, 125, 117, 10.04, 10.13

See application file for complete search history.

(56) References Cited

U.S. PATENT DOCUMENTS

| | | | | |
|---|---|---|---|---|
| 6,672,579 | B2 * | 1/2004 | Araki et al. | 271/122 |
| 7,344,133 | B2 * | 3/2008 | Miki | 271/122 |
| 7,641,189 | B2 | 1/2010 | Nobe et al. | |
| 7,832,723 | B2 * | 11/2010 | Tsukamoto et al. | 271/125 |
| 7,900,909 | B2 | 3/2011 | Hiura et al. | |
| 8,430,393 | B2 | 4/2013 | Matsushima et al. | |
| 2011/0006469 | A1 | 1/2011 | Matsushima et al. | |
| 2012/0153561 | A1 * | 6/2012 | Koga | 271/121 |

FOREIGN PATENT DOCUMENTS

| | | | | |
|---|---|---|---|---|
| EP | 2 455 313 | A1 | 5/2012 | |
| JP | 2000177874 | A * | 6/2000 | B65H 3/52 |

* cited by examiner

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

A sheet feeding portion is provided with a pair of separation rollers that include a feed roller which conveys the sent sheet and a retard roller which applies a rotation force to return the sheet in a direction opposite to a sheet feeding direction through a torque limiter in a state of being pressed against the feed roller. The sheet feeding portion further includes a rotation transmitting mechanism that transmits a rotation of the retard roller, at the time of sending the sheet to the sheet feeding direction, to the pickup roller and a changing mechanism that switches a retard pressure, which allows the retard roller to be pressed against the feed roller, according to a reaction force that is transmitted to the retard roller from the pickup roller.

15 Claims, 8 Drawing Sheets

SHEET FEEDING APPARATUS AND IMAGE FORMING APPARATUS

BACKGROUND OF THE INVENTION

1. Field of the Invention

The invention relates to a sheet feeding apparatus that is provided in an image forming apparatus such as a copying machine, a facsimile machine, a laser beam printer, or a complex machine and an image forming apparatus provided with the sheet feeding apparatus.

2. Description of the Related Art

The sheet feeding apparatus provided in the image forming apparatus is required to feed sheets at a constant interval between sheets so as to improve productivity (the number of sheets to be formed with images per unit time).

In a separation method of the related art using a retard roller which rotates in a direction opposite to a sheet feeding direction, the following configuration has been proposed to improve the productivity.

The separation method using the retard roller is configured such that sheets are sent by a pickup roller and then is separated and fed one by one by a feed roller and a retard roller. Since a rotary driving is transmitted to the retard roller in the direction opposite to the sheet feeding direction through a torque limiter, when a plurality of sheets enters the separation nip portion between the feed roller and the retard roller, the retard roller reversely rotates to separate the sheets one by one. In addition, when one sheet is fed to the separation nip portion between the feed roller and the retard roller, the retard roller is driven by the sheet to be fed and then rotates in a sheet sending direction.

In the separation method using the retard roller, then, when the retard roller is driven by the sheet, the driven rotation of the retard roller is transmitted to the pickup roller to rotate the pickup roller, in order to improve the productivity. Therefore, the pickup roller feeds the next sheet successively after a trailing end of a preceding sheet passes through the position of the pickup roller so that the leading end of the next sheet is moved to the position of the separation nip portion (see U.S. Pat. No. 8,430,393).

The separation method using the retard roller disclosed in U.S. Pat. No. 8,430,393 can resolve variation of the leading position (interval between sheets) of the sheet to be fed in a successive sheet feeding operation. In this technique, that is, when the retard roller is rotating in the sheet feeding direction, the rotation is transmitted to the pickup roller to rotate the sheet in the sheet sending direction. In addition, when the retard roller is rotating or stopping in the direction opposite to the sheet feeding direction, the pickup roller does not feed the sheet. Thus, during the successive feeding, the pickup roller continuously rotates in a state where the retard roller is driven by the preceding sheet. Therefore, the next sheet is successively sent without a gap with the preceding sheet, and then the leading end of the next sheet is stopped at the separation nip portion between the feed roller and the retard roller. Accordingly, during the successive sheet feeding, the leading end of the sheet is always positioned at the separation nip portion, and thus the interval between the sheets can be constant. Thus, the productivity can be improved.

However, since the technique disclosed in U.S. Pat. No. 8,430,393 is a method of interlocking the pickup roller with the rotation of the retard roller, the load when the pickup roller sends the next sheet during the interlocking acts to the retard roller. That is, the load is a reaction force which is applied to the pickup roller from the sheet, and an unnecessary force is applied to the retard roller through an interlocking mechanism by the load. This may cause the decrease in a pressing force (separation force) against the sheet of the retard roller to occur a slip between the retard roller and the sheet, and thus there is a possibility to make a trouble of a defective sheet feeding or an early abrasion of the retard roller.

The invention is to provide a sheet feeding apparatus and an image forming apparatus which are configured so as not to decrease the separation pressure by the load from the pickup roller in a way where the pickup roller interlocks with the rotation of the retard roller.

SUMMARY OF THE INVENTION

The invention is to provide a sheet feeding apparatus including: a sheet stacking portion which stacks a sheet; a feeding roller which sends the sheet stacked on the sheet stacking portion to a sheet feeding direction; a pair of separation rollers which includes a conveyance roller which conveys the sheet sent by the feeding roller and a separation roller which is provided so as to be capable of being pressed against the conveyance roller and applies a rotation force to return the sheet in a direction opposite to the sheet feeding direction through a torque limiter; a rotation transmitting portion which transmits a rotation of the separation roller, when the separation roller co-rotates with the sheet separated by the pair of separation rollers, to the feeding roller; and a separation pressure changing portion which increases a separation pressure which allows the separation roller to be pressed against the conveyance roller, when the rotation of the separation roller is transmitted to the feeding roller by the rotation transmitting portion.

Further features of the present invention will become apparent from the following description of exemplary embodiments with reference to the attached drawings.

DESCRIPTION OF THE EMBODIMENTS

Hereinafter, exemplary embodiments of the invention will be described in detail with reference to drawings. Furthermore, shapes and relative positions of components described in the following embodiments are appropriately modified in accordance with configurations or various conditions of an apparatus to which the invention is applied. Therefore, the scope of the invention is not intended to be limited thereto.

[Image Forming Apparatus]First, a schematic configuration of an electrophotographic typed image forming apparatus according to the present embodiment will be described with reference to FIG. 1. Further, FIG. 1 is a cross-sectional view of an image forming apparatus 100.

Figure 1A:
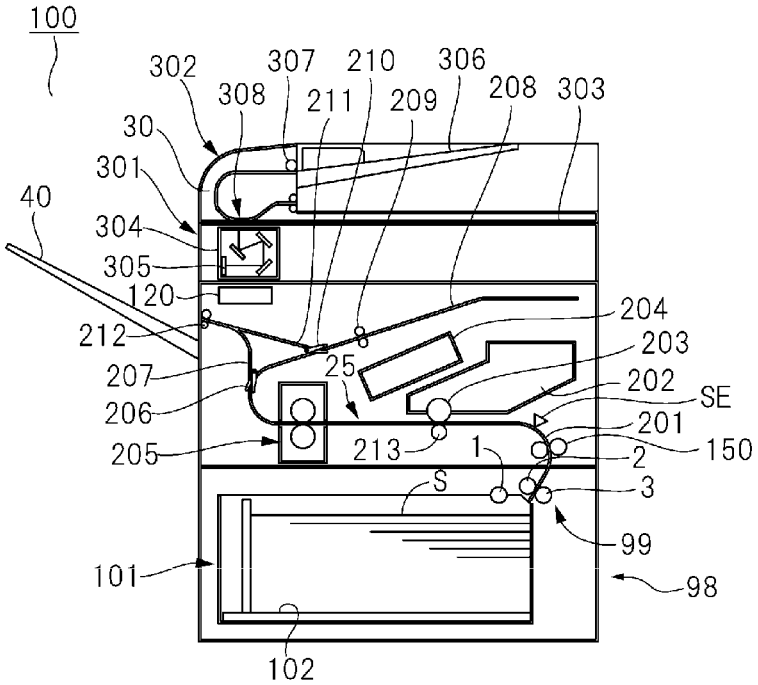
FIG. 1A is a schematic cross-sectional view illustrating an image forming apparatus according to a first embodiment.

As illustrated in FIG. 1A, the image forming apparatus 100 includes an image forming portion 25 and a sheet feeding apparatus 98 that sequentially feeds a sheet S from a bundle of stacked sheets to the image forming portion 25.

Moreover, the image forming apparatus 100 includes an image reading portion 30 and a discharge tray 40. The image reading portion 30 is connected to the image forming portion 25 and reads out information disclosed in a document, and the discharge tray 40 stacks the sheet S on which an image is formed by the image forming portion 25 to be discharged. In addition, a control portion 120 is provided inside the image forming apparatus 100 to control each portion of the apparatus. Furthermore, the control portion 120 may control both of the image forming apparatus and the sheet feeding apparatus. Alternatively, the control portion 120 may control only the image forming apparatus, and another control portion 120A (illustrated in FIG. 1B) may control the sheet feeding apparatus.

The image forming portion 25 forms the image on the sheet S that is sent from the sheet feeding apparatus 98 and is conveyed to an image forming process unit 202 through a conveyance guide 201. The image forming process unit 202 forms the image (toner image) on the sheet S by the electrophotographic type.

Specifically, a photosensitive drum 203 provided in the image forming process unit 202 is electrically charged, and then the charged photosensitive drum 203 is irradiated by a laser scanner 204 with light to form an electrostatic image thereon. Moreover, the electrostatic image is developed as a toner image by a developing device (not illustrated), and the toner image is transferred onto the sheet S by a transfer portion including a transfer roller 213.

Then, the sheet S, onto which the toner image is transferred, is conveyed to a fixing device 205, and then the image is fixed to the sheet S by heat and pressure. Thus, the sheet S, to which the image is fixed, is sent to either a face-up conveyance path 207 or a switch back conveyance path 208 that reverses upper and lower sides of the sheet S by a switching of a switching member 206 that switches conveyance paths.

The sheet S sent to the switch back conveyance path 208 is conveyed by a pair of switch back conveyance rollers 209 until a trailing end of the sheet passes through a reverse switching member 210. Thereafter, the sheet S is conveyed in a state where the past trailing end is reversed upside down as a leading end by a reverse driving of the pair of switch back conveyance rollers 209.

At this time, when the reverse switching member 210 is switched, the reversed sheet S is sent to a face-down conveyance path 211. The face-up conveyance path 207 and the face-down conveyance path 211 join in front of a pair of discharge rollers 212. The sheet S guided to the face-up conveyance path 207 and the sheet S guided from the switch back conveyance path 208 to the face-down conveyance path 211 are both discharged and stacked to/on the discharge tray 40 by the pair of discharge rollers 212.

The image reading portion 30 includes a scanner portion 301 and an automatic document feeding portion (hereinafter, referred to as an "ADF") 302. The ADF 302 is configured to be openable and closable using a hinge (not illustrated) of a rear side (back side of FIG. 1) of the apparatus, as a fulcrum, and is opened and closed at the time of setting the document (not illustrated) on a platen glass 303. In addition, the scanner portion 301 includes a movable protrusion carriage 304 and is configured to read out the information disclosed in the document.

In the scanner portion 301, the information disclosed in the document, which is set on the platen glass 303, is read out by a scanning of the protrusion carriage 304 in a horizontal direction, and then the information is photoelectrically converted by a CCD 305. The ADF 302 separates and feeds a plurality of document sheets, which is stacked on a document stacking tray 306, one by one by a document feeding roller 307 and makes the document pass through a document reading position 308 of the carriage 304 which is at stop inside the scanner portion 301. When the document passes through the document reading position 308, the carriage 304 reads out the information disclosed in the document under the conveyance.

Subsequently, the sheet feeding apparatus of the present embodiment will be described, but in order to easily understand the sheet feeding apparatus of the present embodiment, first, a retard-typed sheet feeding portion for feeding the sheet S in a sheet feeding apparatus which is a premise of the present embodiment will be described with reference to FIG. 7A. Furthermore, FIG. 7A is a perspective view illustrating the sheet feeding portion of the sheet feeding apparatus which is a premise of the present embodiment.

Figure 7A:
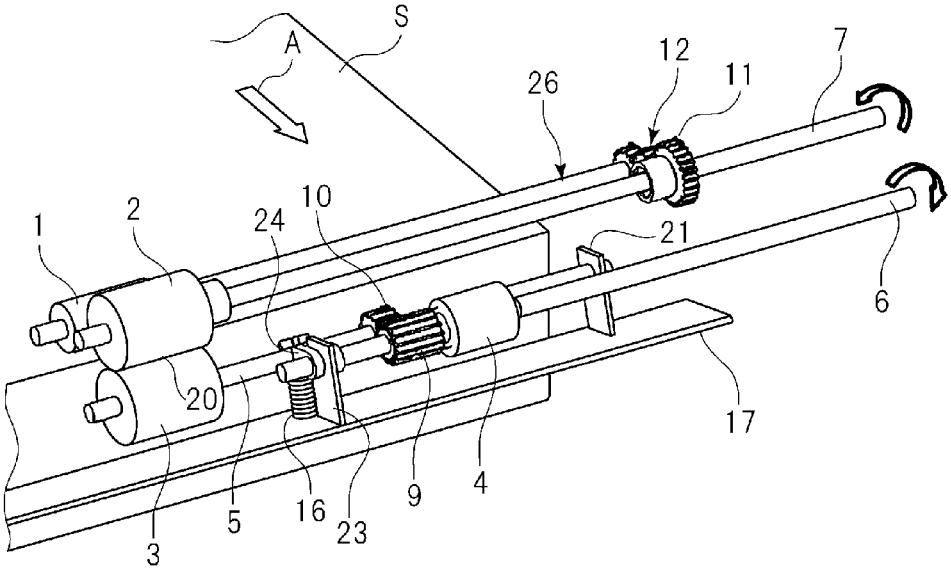
FIGS. 7A and 7B are perspective views illustrating a sheet feeding apparatus which is a premise of the invention.

The sheet feeding portion illustrated in FIG. 7A includes a pickup roller (feeding roller) 1 that feeds (picks up) the stacked and set sheet S and a feed roller (conveyance roller) 2 that conveys the picked up sheet S. The sheet feeding portion further includes a retard roller (separation roller) 3 that is disposed so as to face the feed roller 2 to separate and feed the plurality of sheets one by one.

The feed roller 2 is driven to rotate by a supply of a feeding driving force from a driving source (not illustrated) to a feed roller shaft 7 in accordance with a predetermined feeding timing. The feed roller shaft 7 is rotatably supported by a support frame (not illustrated) in a state of extending in a width direction perpendicular to a sheet feeding direction (direction of an arrow A in FIG. 7A).

The pickup roller 1 is driven to rotate when the rotary driving of the feed roller 2 is transmitted to a pickup roller gear train 12 from a feed roller gear 11 fixed to the feed roller shaft 7. The pickup roller gear train 12 includes a pickup gear which is fixed to a pickup roller shaft 26 and an idler gear which is disposed between the pickup gear and the feed roller gear 11. The pickup roller shaft 26 is disposed in parallel with the feed roller shaft 7 and is rotatably supported by a support frame (not illustrated).

The retard roller 3 is attached to one end of a retard roller shaft 5, and the other end of the retard roller shaft 5 is tiltably supported using a supporting portion 21 as a supporting point. Moreover, the retard roller shaft 5 is supported by a swing member 24 that is swingingly supported on a supporting portion 23 provided near the retard roller 3. With this configuration, the retard roller shaft 5 is swingingly supported around a retard roller driving shaft 6. A retard biasing spring 16, which is configured by a compression spring, abuts on the swing member 24, and the retard roller 3 is pressed against the feed roller 2 by applying the retard roller 3 with a force toward the feed roller 2. Furthermore, the supporting portions 21 and 23 are erected and fixed to the support frame 17 of the feeding mechanism.

With this configuration, the retard roller 3 is configured to swing around a shaft core of the retard roller driving shaft 6 and to be pressed against the feed roller 2. The retard roller driving shaft 6 is disposed in parallel with the retard roller shaft 5. Then, the retard roller driving shaft 6 is connected to the retard roller shaft 5 by an engagement between a torque limiter gear 9 provided on the retard roller driving shaft 6 and a gear 10 fixed to the retard roller shaft 5, thereby transmitting the driving of the retard roller driving shaft 6 to the retard roller shaft 5. The torque limiter gear 9 is a gear that is attached to a torque limiter 4 connected to the retard roller driving shaft 6. Furthermore, the torque limiter 4 may be disposed within a transmission path that transmits the driving to the separation roller from a driving source D2.

A driving transmission force (limit value) of the torque limiter 4 is set to be larger than a frictional force between the sheets to be used and is set to be smaller than the frictional force due to a frictional coefficient between the sheet and the feed roller 2. Therefore, as the sheet S which enters a separation nip portion 20 between the feed roller 2 and the retard roller 3, when one sheet or no sheet enters the separation nip portion 20, since the driving transmission is cut off by the torque limiter 4, the retard roller 3 co-rotates in accordance with the rotation of the feed roller 2. The direction of the co-rotation is opposite to the rotation direction for separating the sheet. In addition, when two or more sheets S enter the separation nip portion 20, since the transmission of the driving force is not cut off by the torque limiter, the retard roller 3 rotates in a direction opposite to the sheet feeding direction and thus separates the entered two or more sheets S one by one.

The retard roller 3 abuts on the feed roller 2 with a retard pressure (abutting pressure) N to form the separation nip portion 20. The retard pressure varies depending on a separation state of the sheet due to the retard roller 3. First, the retard roller 3 is forcedly applied to the feed roller 2 with a static pressure (N=N_0) by the retard biasing spring 16 during a non-operation where the driving is not transmitted.

The retard roller 3 is forcedly applied to (bitten into) the feed roller 2 side by a driving load T of the torque limiter 4 at the engaged part of the torque limiter gear 9 and the gear 10 when the driving is transmitted from the retard roller driving shaft 6. For this reason, the retard roller 3 is pressed against the feed roller 2 with a retard pressure (N=N_f) larger than the static pressure (N=N_0). In addition, the retard roller 3 is forcedly applied to the feed roller 2 side with a retard pressure (N=N_R) during the separation operation in a case of separating the sheet at the state where the driving is transmitted.

The configuration in which the retard roller 3 is "bitten into" the feed roller 2 will be described. When the driving is transmitted to the retard roller driving shaft 5 from the driving source D2, in the engaged part of the torque limiter gear 9 and the gear 10, a moment is generated at the swing member 24 by the driving load T of the torque limiter 4 to push the retard roller shaft 5 up onto an upper side of FIG. 7A around the retard roller driving shaft 6. The moment becomes a force for pressing the retard roller 3 against the feed roller 2, and this is called "bite". Furthermore, since the retard roller driving shaft 6 acting as a fulcrum for swinging the retard roller 3 is disposed at a downstream side of the separation nip portion, the moment generates the force which presses the retard roller 3 against the feed roller 2.

Moreover, a configuration in which the pickup roller 1 interlocks with the rotation of the retard roller 3 in the sheet feeding apparatus, which is a premise of the invention, will be described with reference to FIG. 7B. Furthermore, FIG. 7B is a perspective view illustrating the sheet feeding portion which is a premise of the invention.

Figure 7B:
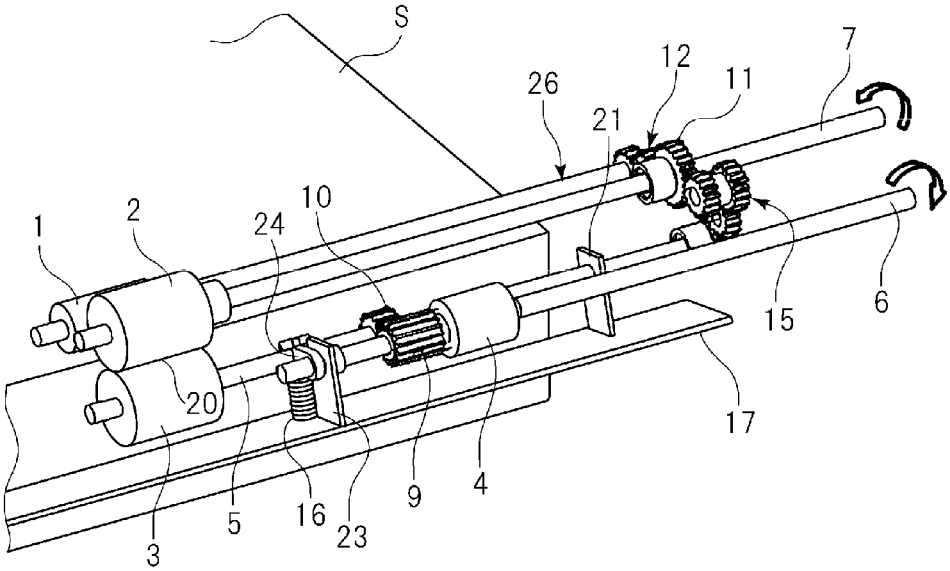

In the sheet feeding portion illustrated in FIG. 7B, an interlock driving gear train 15 is disposed so as to transmit the rotation of the retard roller 3 to the pickup roller 1. The interlock driving gear train 15 is configured such that the retard roller 3 allows the feed roller 2 to be rotated in the sheet feeding direction or allows the pickup roller 1 to be rotated in the sheet feeding direction when co-rotating with the sheet to be conveyed. Then, the co-rotation of the retard roller shaft 5 is transmitted to the pickup roller 1 on the pickup roller shaft 26 through the interlock driving gear train 15, the feed roller gear 11, and pickup roller gear train 12.

By this mechanism, when the trailing end of the preceding sheet passes through the pickup roller 1, the conveyance of a subsequent sheet (hereinafter, referred to as a next sheet) can be started by the pickup roller 1. Consequently, the leading end of the next sheet can constantly wait for a feeding start timing of the next sheet at the separation nip portion 20.

However, during the interlocking, the load is applied to the pickup roller 1 from the sheet, and the load Ts is transmitted to the retard roller 3 through the pickup roller gear train 12, the feed roller gear 11, and the interlock driving gear train 15, and thus the load is applied to the retard roller 3. Since the load Ts acts as resistance against the moment in a direction where the retard roller 3 is pressed against (bitten into) the feed roller 2, the retard pressure between the retard roller 3 and the feed roller 2 decreases significantly. Accordingly, there is a possibility to occur a defective sheet feeding and a roller abrasion due to the load. Therefore, these problems are solved by the embodiments which will be described below.

<First Embodiment>A sheet feeding apparatus of a first embodiment will be described with reference to FIGS. 1 and 2. A sheet feeding apparatus 98 includes a sheet feeding portion 99 and a sheet storage case 101. In the image forming apparatus 100, the sheets S to be image-formed are conveyed one by one to the image forming portion 25 from the sheet storage case 101 by the sheet feeding portion 99. In the image forming portion 25, the image is formed on the sheet to be fed from the sheet feeding portion 99. Furthermore, with respect to the configuration equivalent to the above-described premise configuration, the same reference numeral is denoted.

Figure 1B:
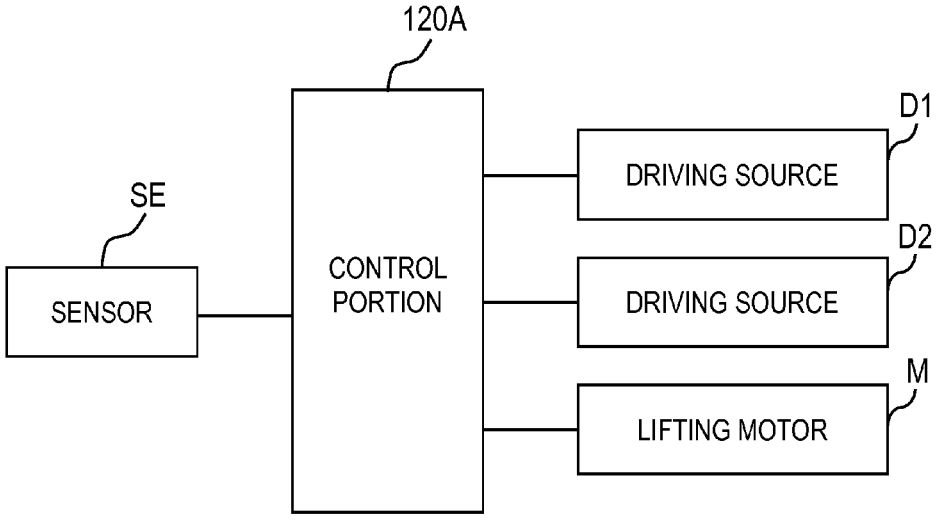
FIG. 1B is a control block diagram.

FIG. 1B is a block diagram for controlling an operation of the sheet feeding apparatus of the present embodiment, and a control portion 120A is connected with a sensor SE, driving sources D1 and D2, and a lifting motor M, which will be described later.

Figure 2:
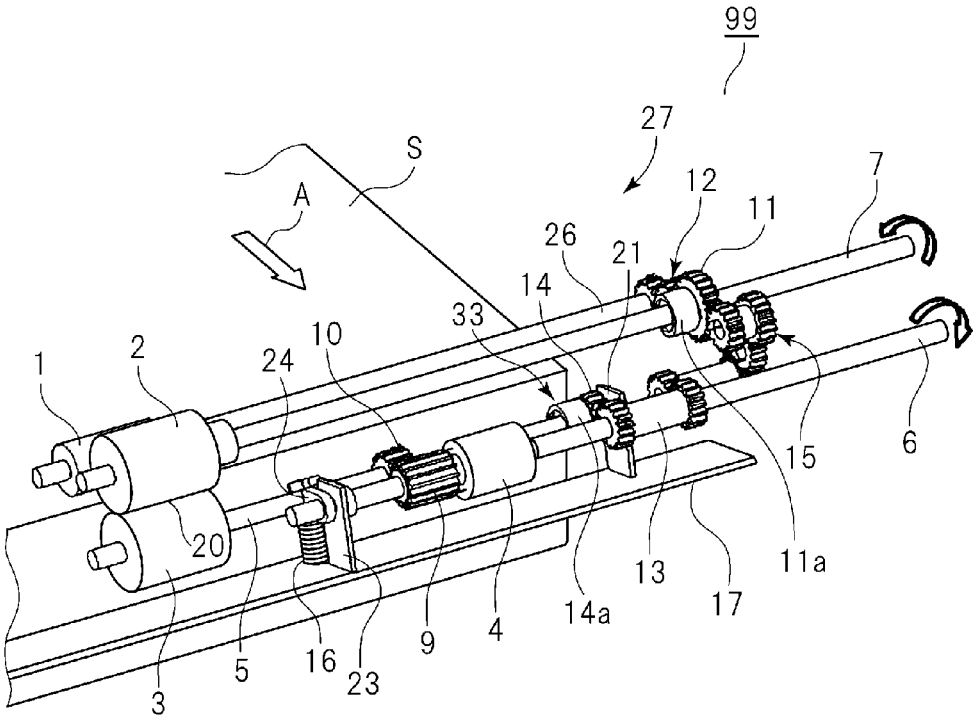
FIG. 2 is a perspective view illustrating a sheet feeding apparatus according to the first embodiment.

As illustrated in FIG. 2, the sheet feeding portion 99 includes the pickup roller 1 as a feeding roller that is disposed downstream (downstream in the direction of the arrow A in FIG. 2) in a sheet feeding direction of the sheet storage case 101 to send the sheet S stacked on a sheet stacking plate (sheet stacking portion) 102 to the sheet feeding direction A. The sheet feeding portion 99 includes the feed roller 2 as a conveyance roller that conveys the sheet S sent by the pickup roller 1 and the retard roller 3 as a separation roller. The feed roller 2 receives the driving, which is generated from the driving source D1 (see FIG. 1B) such as a driving motor, from the feed roller shaft 7 to rotate in the sheet feeding direction. The retard roller 3 is pressed against the feed roller 2 to form the separation nip portion 20, and the driving is transmitted to the retard roller 3 from the driving source D2 (see FIG. 1B) through the torque limiter 4 so that the retard roller 3 rotates in the direction (sheet returning direction) opposite to the sheet feeding direction.

When one sheet S enters the separation nip portion 20 between the feed roller 2 and the retard roller 3, since the driving transmission is interrupted by the torque limiter 4, the retard roller 3 follows the rotation of the feed roller 2 through the sheet to co-rotate in the sheet feeding direction. Further, when the plurality of sheets S enter the separation nip portion 20, the retard roller 3 rotates such that only one sheet is sent and other sheets S return in the direction opposite to the sheet feeding direction.

Furthermore, the driving sources D1 and D2 for driving the feed roller 2 and the retard roller 3 may be a different motor, respectively, and may be configured to transmit the driving generated from one motor to each of the rollers through a plurality of driving transmission paths. In this case, the rotation of each roller is controlled by a clutch disposed in the driving transmission path.

In the sheet feeding portion 99, the uppermost sheet S of the sheet bundle S is separated and fed one by one by the pickup roller 1, the feed roller 2, and the retard roller 3. The sheet stacking plate 102 (see FIG. 1A) is configured to move up and down by receiving the driving force from the lifting motor M (see FIG. 1B). When the uppermost surface of the sheet S stacked on the sheet stacking plate 102 (on the sheet stacking portion) reaches a predetermined position, the pickup roller 1 abuts on the uppermost sheet S to become a state where the sheet is separated and fed by the pickup roller 1, the feed roller 2, and the retard roller 3. When the sheet storage case 101 is pulled out of the sheet feeding portion 99, the sheet stacking plate 102 is lowered by its own weight. Accordingly, the sheet bundle S stacked thereon is also lowered to be apart from the feedable position.

As illustrated in FIG. 1, the sheet separated and fed from the sheet storage case 101 by the sheet feeding portion 99 is conveyed toward the image forming portion by a pair of conveyance rollers 150 disposed downstream of the sheet feeding portion 99. A sensor SE (see FIG. 1B) is disposed downstream of the pair of conveyance rollers 150 to detect the sheet, and the control portion 120A stops the driving source D1 and then stop the driving of the feed roller 2 based on the detection of the sensor SE. Therefore, when the sheet is conveyed by the pair of conveyance rollers 150, since the driving transmission is interrupted, the feed roller 2 rotates by following the sheet. In addition, the retard roller 3 co-rotates by following the sheet due to the cutoff of the torque limiter 4. Furthermore, during the operation of feeding the sheet, the driving is constantly transmitted to the retard roller 3 from the driving source D2, and the separation operation is performed as necessary.

The sheet feeding portion 99 includes a rotation transmitting mechanism 27 as a rotation transmitting portion that transmits the rotation to the pickup roller 1 from the retard roller 3. The rotation transmitting mechanism 27 transmits the rotation of the retard roller 3, in a case where the retard roller 3 co-rotates with the sheet S, to the pickup roller 1 and allows the pickup roller 1 to be rotated in the sheet feeding direction. In addition, the sheet feeding portion 99 includes a changing mechanism constituting a separation pressure changing portion that changes the retard pressure (separation pressure) generated by pressing the retard roller 3 against the feed roller 2 according to a reaction force which is transmitted to the retard roller 3 from the pickup roller 1.

As illustrated in FIG. 2, the rotation transmitting mechanism 27 is configured by a gear train that transmits the rotation of the retard roller 3 rotating in the direction opposite to the sheet feeding direction A to the pickup roller 1. The gear train is configured by an interlocking gear 14 that is connected through a one-way clutch 14*a* serving as a one-way mechanism, an interlock driving gear 13, an interlock driving gear train 15, a feed roller gear 11 attached to the feed roller shaft 7 through a one-way clutch 11*a*, and a pickup roller gear train 12. The interlocking gear 14 is provided at an end of the supporting portion 21 side in the retard roller shaft 5. The interlock driving gear 13 is rotatably supported on the retard roller driving shaft 6 and can rotate independently of the rotation of the retard roller driving shaft 6, and the interlock driving gear 13 is provided with gear portions formed on both sides. Then, the gear portions of the interlock driving gear 13 are engaged with the interlocking gear 14 and the interlock driving gear train 15, respectively. In addition, the feed roller gear 11 is connected to the feed roller shaft 7 through the one-way clutch 11*a* to receive only the rotation in the direction where the feed roller 2 feeds the sheet from the feed roller shaft 7, thereby transmitting the rotation to the pickup roller gear train 12.

A changing mechanism 33 is configured by a part of the gear train of the rotation transmitting mechanism 27 and includes the interlocking gear 14, which is connected to each other through the one-way clutch 14*a*, and the interlock driving gear 13. The changing mechanism 33 is configured to change such that the retard pressure at the interlocking state is higher than that at the normal state. The normal state represents a state where the retard roller 3 co-rotates through the sheet by following the rotation of the feed roller 2, which is rotated by the driving transmitted from the driving source D1. At this time, since the driving is also transmitted to the pickup roller 1 from the feed roller shaft 7 through the pickup roller gear train 12, the pickup roller 1 rotates in the sheet feeding direction. In addition, the interlocking state represents the time where the pickup roller 1 interlockingly rotates by the co-rotation of the retard roller 3 due to the sheet S1 conveyed by the a pair of conveyance rollers 150, using the rotation transmitting mechanism 27 to be capable of sending a subsequent sheet S2 to the separation nip portion 20.

Furthermore, the retard pressure at the separation state is lower than that at the interlocking state and the normal state. The separation state represents the time of sending one sheet of the plural sheets S, which are entered into the separation nip portion 20 between the feed roller 2 and the retard roller 3, to the sheet feeding direction "A" using the feed roller 2 and concurrently returning another sheet S to the opposite direction using the retard roller 3.

Figure 6A:
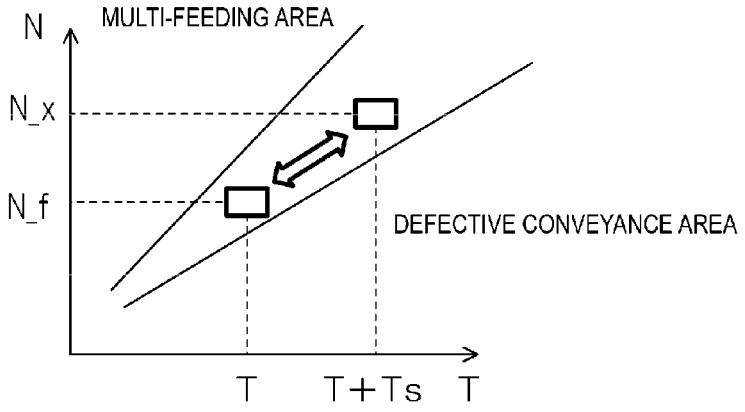
FIGS. 6A, 6B, and 6C are diagrams illustrating a relation between the retard pressure and a conveyance condition according to the invention.
Figure 6B:
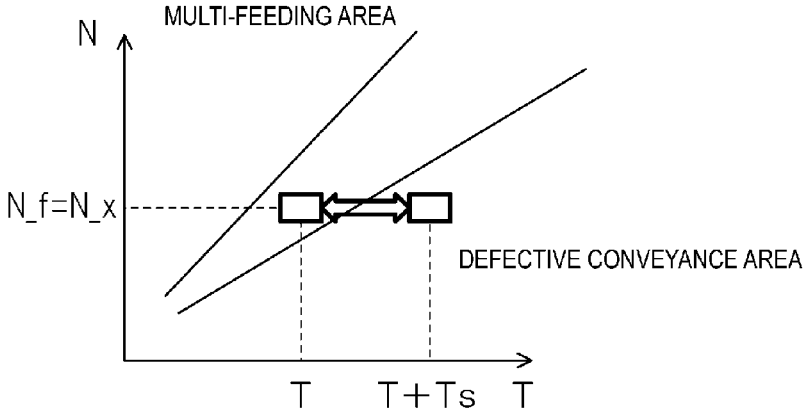

Here, a principle of the sheet feeding apparatus of the present embodiment will be described with reference to graphs of FIGS. 6A to 6C. In each graph, a vertical axis indicates the retard pressure due to the retard roller 3, and a horizontal axis indicates the load of the pickup roller 1.

In the premise configuration illustrated in FIG. 7B, under the retard pressure and a conveyance condition of the torque limiter value, the load applied to the retard roller 3 is replaced even in a state where the torque limiter value is increased by a load Ts from the pickup roller 1. Accordingly, as illustrated in FIG. 6B, the conveyance condition is in a defective conveyance area to become a state where the conveyance is disadvantageous, and thus there is a high possibility to cause the defective conveyance. The load Ts from the pickup roller 1 is a load (reaction force) applied from the sheet, when the pickup roller 1 is feeding the sheet.

Meanwhile, in the configuration according to the present embodiment, as the load Ts applied to the retard roller 3 from the pickup roller 1 at the interlocking state is applied in the direction where the retard roller 3 is pressed against the feed roller 2, the retard pressure at the interlocking state has become larger than that at the normal state. That is, as illustrated in FIG. 6A, when the retard pressure at the interlocking state is denoted as $N_x$ and the retard pressure at the normal state is denoted as $N_f$, the relation of $N_f<N_x$ is satisfied. As a result, an appropriate conveyance condition is satisfied even at the interlocking state of the pickup roller 1. Furthermore, at this time, the retard pressure N needs to be a value of $F_1<\mu N$, when conveyance resistance (load in conveyance direction) at the interlocking state is denoted as "F_1" and a frictional coefficient between the roller and the sheet is denoted as "μ".

Figure 6C:
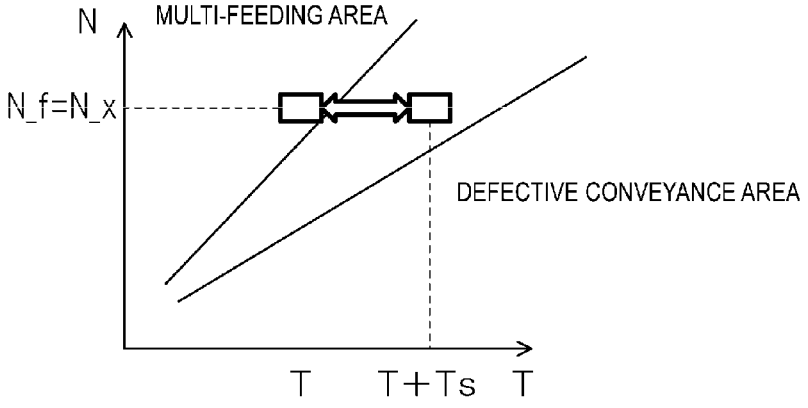

Here, a case (N_f=N_x) where the retard pressure at the interlocking state and the retard pressure at the normal state are equal to each other as illustrated in FIG. 6C will be considered. In this case, as the retard pressure N_f at the normal state increases, resistance to multi-feeding property decreases. In this way, it is turned out to be unsatisfactory when the resistance to multi-feeding property and a necessary pressure at the interlocking state are incompatible to each other. However, it is understood that the condition is difficult and the retard pressure at the interlocking state and the retard pressure at the normal state needs to be generated separately.

Figure 3:
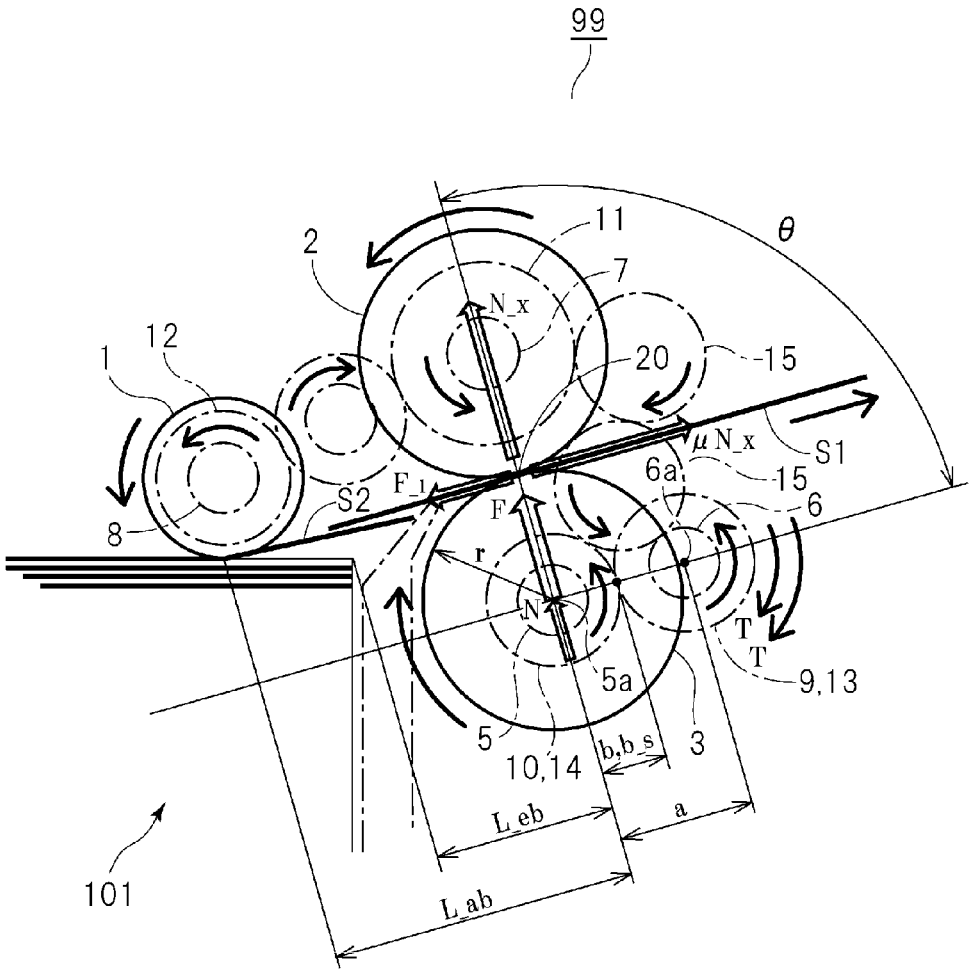
FIG. 3 is a cross-sectional view illustrating an operation of the sheet feeding apparatus according to the first embodiment.

The present embodiment will be further described in detail with reference to FIGS. 2 and 3. Furthermore, FIG. 3 is a cross-sectional view illustrating an operation of the sheet feeding portion 99.

When the retard pressure at the normal state is denoted as "N_f", the retard pressure at the interlocking state is denoted as "N_x", the conveyance resistance (load in conveyance direction) at the interlocking state is denoted as "F_1", and the fictional coefficient between the roller and the sheet is denoted as "μ", it is set to satisfy the condition of N_f<N_x and F_1<μN. Therefore, the load Ts from the pickup roller 1 is generated near the swing center of the retard roller 3, and the retard roller 3 swings by the load Ts of the pickup roller 1 to be pressed against the feed roller 2. This operation will be described. The load Ts of the pickup roller 1 is transmitted to the pickup roller gear train 12, the feed roller gear 11, the interlock driving gear train 15, and the interlock driving gear 13. At this time, at the engaged part of the interlock driving gear 13 and the interlocking gear 14, a moment is applied to the swing member 24 by the load from the pickup roller 1 to push the retard roller shaft 5 up onto an upper side around the retard roller driving shaft 6. Then, the force is applied to the direction, where the retard roller 3 is pressed against the feed roller 2 by this moment (biting force is generated).

As described above, since the biting force is generated by the load Ts from the pickup roller 1 at the interlocking state, the retard roller 3 has a large biting force by the combination of the above biting force and a biting force when the driving from the driving source D2 is transmitted through the torque limiter 4. Therefore, the retard pressure of the retard roller 2 is prevented from being decreased at the interlocking state.

In order that a pressure change is not generated by the changing mechanism 33 during a reversal of the retard roller 3 for separating the sheet, the one-way clutch is built in the torque limiter gear 10 on the retard roller shaft 5 so as not to transmit the rotation force to the torque limiter gear 9 side during the reversal.

Furthermore, the changing mechanism 33 needs to allow the biting force due to the load Is of the pickup roller 1 to be generated at only the interlocking state. That is, the biting force due to the load Ts of the pickup roller 1 is not generated in the retard roller 3 at the normal state. The configuration described above will be described. In order to divide the driving at the normal state and the driving at the interlocking state, a gear ratio of the interlock driving gear train 15 is set such that a circumferential speed (conveyance speed) Vc of the retard roller at the interlocking state and a circumferential speed (conveyance speed) Va of the pickup roller at the interlocking state is Va<Vc. That is, the relation of Va<Vc is satisfied by the changing mechanism 33 as the separation pressure changing portion, when the sheet feeding speed of the retard roller 3 at the interlocking state is denoted as Vc and the sheet feeding speed of the pickup roller 1 at the interlocking state is denoted as Va.

By the difference of the above circumferential speed, the biting force is not generated in the retard roller 3 even when the pickup roller 1 rotates in the sheet feeding direction at the normal state. This is because the one-way clutch 14*a* is provided between the interlocking gear 14 and the retard roller shaft 5 as an interruption portion. With this configuration, since the rotation speed (circumferential speed) of the retard roller shaft 5 is slower than that of the interlocking gear 14 due to the rotation transmitted through the interlock driving gear train 15 at the normal state, the moment is not generated by the load Ts from the pickup roller 1 at the engaged part of the gear. Accordingly, since the biting force is not generated by the load Ts of the pickup roller 1 in the retard roller 3 except at the interlocking state, the retard pressure is settled at N_f by the biting force due to the torque limiter 4.

In addition, it is necessary to have the relation of the circumferential speed at which the next sheet S2 (FIG. 3) can be conveyed to the separation nip portion 20 by the pickup roller 1 at the interlocking state. As illustrated in FIG. 3, when the distance between a sheet contact position of the pickup roller 1 and a position of the separation nip portion 20 is denoted as "L_ab" and the distance between a leading position of the sheet on the sheet stacking plate and the position of the separation nip portion 20 is denoted as "L_ab", the relation of L_ab/Vc≥L_eb/Va is set.

That is, the sheet feeding speed of the retard roller 3 at the interlocking state is denoted as Vc, and the sheet feeding speed of the pickup roller 1 at the interlocking state is denoted as Va. Further, the distance between the sheet contact position of the pickup roller 1 and the position of the separation nip portion 20 is denoted as "L_ab", and the distance between the leading position of the sheet on the sheet stacking plate 102 and the position of the separation nip portion 20 is denoted as "L_eb". At this time, the relation of L_ab/Vc≥L_eb/Va is satisfied by the changing mechanism 33.

Furthermore, the circumferential speed (conveyance speed) Vb of the feed roller 2 is required to be equal to the circumferential speed (conveyance speed) Va of the pickup roller 1 at the normal state. Accordingly, the feed roller gear 11 is connected to the feed roller shaft 7 through the one-way clutch 11*a*. For this reason, the driving of the feed roller shaft 7 is transmitted to the pickup roller 1 through the pickup gear train 12, and the rotation of the retard roller 3 is not influenced by the rotation transmitting mechanism 27.

Figure 5A:
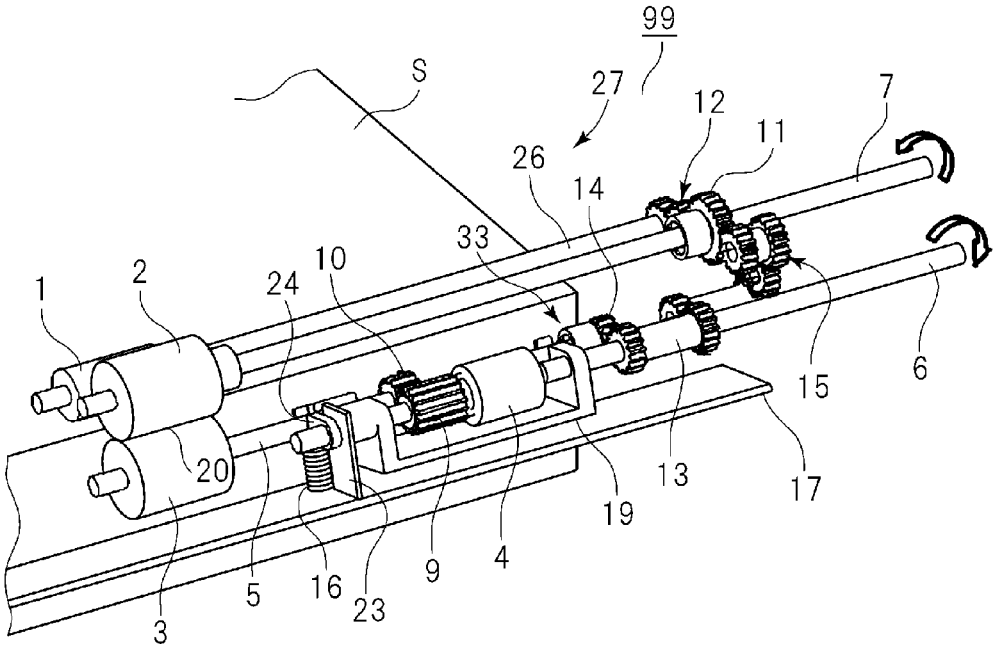
FIG. 5A is a perspective view of a sheet feeding apparatus according to a third embodiment.
Figure 5B:
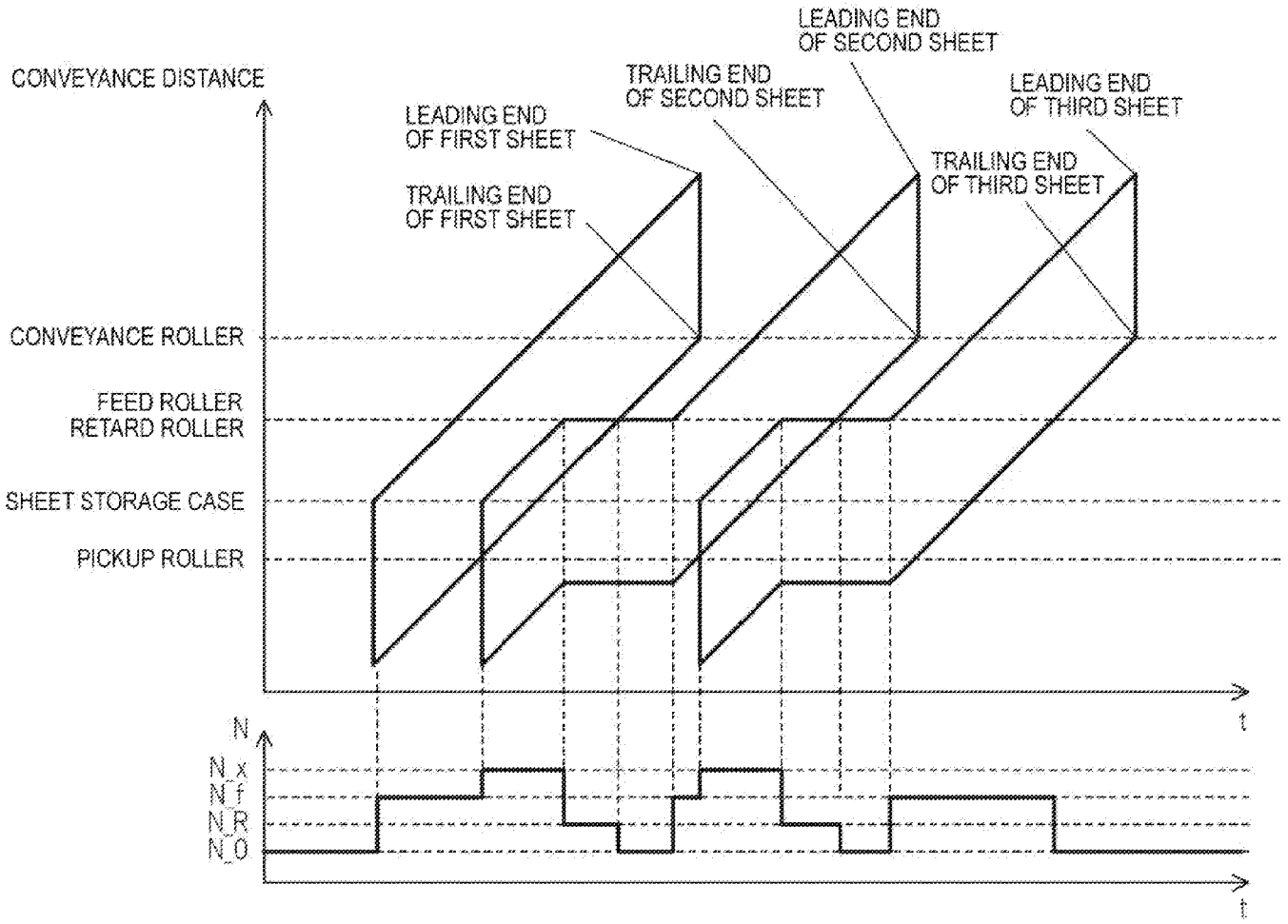
FIG. 5B is a diagram illustrating a relation between a sheet conveyance and a retard pressure according to the invention.

The relation between a sheet conveying operation and the retard pressure N by this mechanism will be described with reference to FIGS. 3 and 5B. Furthermore, FIG. 5B is a diagram illustrating the relation between the sheet conveyance and the retard pressure according to the present embodiment.

A first sheet S is sent to the separation nip portion 20 from the sheet storage case 101 by the pickup roller 1 and is conveyed to the pair of conveyance rollers 150 disposed downstream of a conveyance path by the feed roller 2. After the conveyance of the first sheet S is started by the pair of conveyance rollers 150, when the sensor SE detects the leading end of the sheet, the driving source D1 is controlled by the control portion 120A, and then the driving of the feed roller 2 is cut off. At this time, the first sheet S1 is taken out to be conveyed from the separation nip portion 20 between the feed roller 2 and the retard roller 3 by the pair of conveyance rollers 150.

The first sheet S1 is picked up and conveyed to the pair of separation rollers 2 and 3, which are configured by the feed roller 2 and the retard roller 3, and until the trailing end thereof passes through the pickup roller 1, the retard pressure N becomes the retard pressure N_f at the normal state. That is, the retard roller 3 is pressed against the feed roller 2 with the pressure N_f by the biting force due to the load T of the torque limiter 4.

Then, when the trailing end of the first sheet S1 passes through the pickup roller 1, a second sheet is sent by the pickup roller 1 to which the rotation of the retard roller 3, which rotates by following the first sheet, is transmitted through the interlock driving gear train 15. Thus, the conveyance of the second sheet S2 is started. At this time, the retard pressure N increases from the retard pressure N_f at the normal state to the retard pressure N_x at the interlocking state by the biting force due to the load Ts acting from the pickup roller 1 side.

The leading end of the second sheet S2 is sent up to the separation nip portion 20 with a state where a part of the trailing end of the first sheet S1 and the leading end of the second sheet S2 is overlapped. The leading end of the second sheet S2, which has reached the separation nip portion 20 in the overlapped state, stops at separation nip portion 20 by the separation function of the retard roller 3, and the first sheet S1 is pulled out to be conveyed by the pair of conveyance rollers 150 on the downstream side. At this time, the retard pressure N becomes a retard pressure N_R at the separation state.

When the trailing end of the first sheet S1 passes through the separation nip portion 20, since the driving source D1 is at a stop, the second sheet S2 waits until a next feeding start timing at the separation nip portion 20. At this time, the retard pressure N becomes a retard pressure N_0 of the static pressure at the stopping state (waiting state). Furthermore, since the biting force is generated due to the position of the swing fulcrum of the retard roller 3, the retard pressure N_R at the separation state becomes larger than the retard pressure N_0 of the static pressure and becomes smaller than the retard pressure N_f at the normal state.

As in the case of the first sheet, when the feeding of the second sheet S2 is started, the leading end of a third sheet is also conveyed up to the separation nip portion 20 by the effect of an interlock driving train. With respect to subsequent sheets, the above operation is also repeated, and the sheet feeding start position is set such that the leading end of the sheet is positioned at the separation nip portion 20.

Next, a setting manner of each retard pressure will be described. The retard pressure N_f at the normal state is set based on each of the following values. Examples of the values include the retard pressure N_0 of the static pressure, the torque limiter value T, a radius "r" during the operation of the retard roller, a distance L (see FIG. 4B) between the supporting portion 21 and the retard roller 3, and a distance "1" (see FIG. 4B) between the supporting portion 21 and the torque limiter gear 10. Examples of the values further include a torque-limiter-gear-pitch circle radius "b" of the retard roller shaft 5 side and a distance (predetermined distance) "a" between the retard roller shaft 5 (rotation center 5*a* thereof) and the retard driving shaft 6 (swing center 6*a* thereof).

The retard pressure N_x at the interlocking state is set based on the respective following values in addition to the retard pressure N_f at the normal state. Examples of the values include the load Ts of the pickup roller which is transmitted through the interlock driving gear train 15, a distance "ls (l_s)" (see FIG. 4B) between the supporting portion 21 acting as a fulcrum of the retard roller shaft and the interlocking gear 14, and a torque-limiter-gear-pitch circle radius "b_s" of the retard roller shaft 5 side. In addition, the value includes the distance "a" between the retard roller shaft 5 and the retard driving shaft 6.

When an angle between a center line connecting the feed roller 2 with the retard roller 3 and a center line connecting the retard roller shaft 5 and the retard driving shaft 6 is denoted as a retard biting angle θ, the retard pressure "N_1" can be represented by the following Expression (1).

[Expression 1]

$$N_X = \left(-\frac{1}{r\tan\theta} + \frac{l}{bL\sin\theta}\right)\left(\frac{a-b}{b}\right)T + N_0 + \left(-\frac{1}{r\tan\theta} + \frac{l_s}{b_s L\sin\theta}\right)\left(\frac{a-b_s}{b_s}\right)T_s \quad (1)$$

At this time, the retard pressure "N_1" needs to be a value which satisfies the relation of "F_1<μN_x", when the load in conveyance direction is denoted as "F_1" and the frictional coefficient between the roller and the sheet is denoted as "μ". Furthermore, the retard pressures N_f (Nf) and N_R (NR) can be represented by the following Expressions (2) and (3).

[Expression 2]

$$N_f = \left(-\frac{1}{r\tan\theta} + \frac{l}{bL\sin\theta}\right)\left(\frac{a-b}{b}\right)T + N_0 \quad (2)$$

[Expression 3]

$$N_R = \frac{N_0}{1-\left(-\frac{1}{\tan\theta} + \frac{rl}{bL\sin\theta}\right)\mu} \quad (3)$$

Each of the retard pressures is set based on these Expressions.

In the present embodiment, while performing the interlocking of the pickup roller 1 and the retard roller 3, the retard pressure due to the retard roller 3 depending on the load from the pickup roller 1 is changed as a pressure corresponding to each of the normal state, the interlocking state, the separation state, and the waiting state. Therefore, the leading end of the sheet can be always stably-positioned at the separation nip portion 20 at the start of the feeding, and the interval between the sheets can be constantly controlled during a successive feeding to stably perform a successive feeding.

Furthermore, in the present embodiment, the gear train is used as the rotation transmitting portion, but another transmitting portion may be used as the rotation transmitting portion based on the friction of a belt without being limited to the gear train.

Figure 4A:
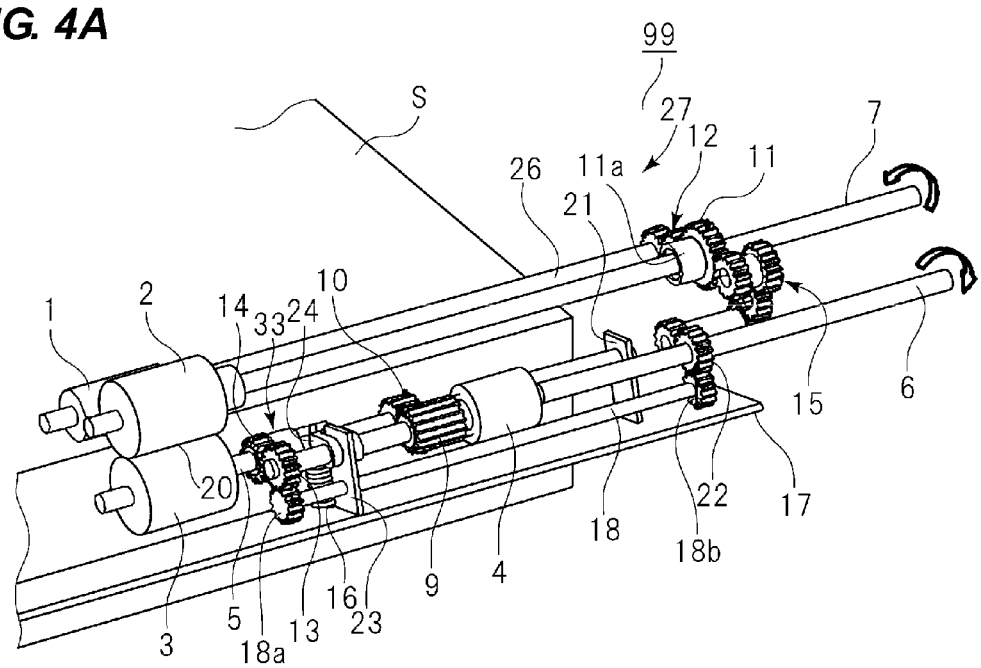
FIG. 4A is a perspective view illustrating a sheet feeding apparatus according to a second embodiment.
Figure 4B:
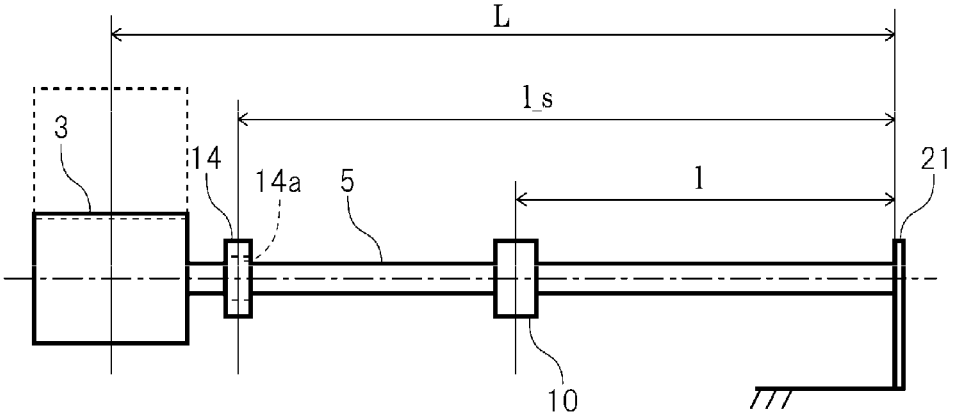
FIG. 4B is a diagram illustrating a retard roller supporting structure according to the second embodiment.

<Second Embodiment>Next, a second embodiment according to the invention will be described with reference to FIG. 4. Furthermore, FIG. 4A is a perspective view illustrating a sheet feeding portion 99 as a sheet feeding apparatus according to the present embodiment, and FIG. 4B is a diagram illustrating a supporting structure of the retard roller according to the present embodiment.

That is, as with the description in the first embodiment, the retard pressure $N_{13}$ 1 at the interlocking state can be set by the distance "l" between the supporting portion 21 and the torque limiter gear 10 and the distance "ls" between the supporting portion 21 and the interlocking gear 14.

In order to satisfy the operation condition "F_1<μN_x", there is a case where the condition of l<ls is desired to be satisfied. In this case, the configuration of the first embodiment is required to pass and transmit the driving through the torque limiter 4 and the torque limiter gear 9 fixed on the retard driving shaft 6 for transmitting the reversal driving. However, it is not possible to dispose the interlock driving gear train 15 which transmits the rotation in the direction of forward rotation to pass through the torque limiter 4 for reversely driving on the same shaft as the retard driving shaft 6.

Here, the configuration of the second embodiment, which is configured to cope with the above problem, will be described with reference FIGS. 4A and 4B. In order to cope with the above problem, that is, the present embodiment is configured such that an idler gear 18*a* connected to the interlock driving gear 13 of the retard driving shaft 6 and a shaft 18 provided with the idler gear 18*a* are disposed as illustrated in FIG. 4A. In the shaft 18, a gear 18*b* engaging with the interlocking gear 22 is attached to an end side opposite to the idler gear 18*a*.

In the present embodiment, at the interlocking state, the rotary driving of both rollers 3 and 1 is transmitted to the pickup roller shaft 26 from the retard roller shaft 5 through the following paths. That is, the rotary driving of both rollers 3 and 1 is transmitted to the pickup roller shaft 26 through the interlocking gear 14 on the retard roller shaft 5, the interlock driving gear 13 on the retard driving shaft 6, the idler gear 18*a*, the interlocking gear 22 on the retard driving shaft 6, the interlock driving gear train 15, the feed roller gear 11, the pickup roller gear train 12 at the interlocking state.

Therefore, the interlock driving train is disposed to forwardly rotate with the retard driving shaft 6, and thus the relation of l<ls can be set. For this reason, since the distance "ls" from the supporting portion 21 is configured to be longer as compared with the configuration of the first embodiment, the interlocking gear 14 can be set as the retard pressure N_x acting as a greater biting force, and thus it is possible to more easily satisfy the operation condition.

Furthermore, as in the first embodiment, the present embodiment is configured such that the interlocking gear 14 on the retard roller shaft 5 transmits the driving to the pickup roller 1 by the built-in one-way clutch 14*a* as illustrated in FIG. 4B, only when the retard roller 3 co-rotates. The interlock driving gear 13 which is connected to the interlocking gear 14 and is attached to the end on the retard driving shaft 6 is an idler gear, and the interlock driving gear 13 is rotatably attached regardless of the presence or absence of the reversal operation of the retard driving shaft 6. Furthermore, the retard pressure can be represented by the same Expression as in the first embodiment.

The present embodiment described above can obtain the same effects as in the first embodiment.

<Third Embodiment>Next, a third embodiment according to the invention will be described with reference to FIG. 5A. Further, FIG. 5A is a perspective view of a sheet feeding apparatus according to the present embodiment.

In the first and second embodiments, that is, the retard roller 3 is swingingly attached to the retard driving shaft 6 using the supporting portion 21 as a supporting point (fulcrum). In contrast, in the present embodiment, the retard roller 3 is supported so as to be capable of rotating around the retard driving shaft 6 in a state where the predetermined distance "a" (see FIG. 3) between the retard roller shaft 5 and the retard driving shaft 6 is constantly held by a holder 19.

In the present embodiment, the rotation driving at the interlocking state of the retard roller 3 and the pickup roller 1 is transmitted from the retard roller shaft 5 as follows. That is, the rotation driving is transmitted to the pickup roller shaft 26 from the retard roller shaft 5 through the interlocking gear 14 on the retard roller shaft 5, the interlock driving gear 13 on the retard driving shaft 6, the interlock driving gear train 15, the feed roller gear 11, and the pickup roller gear train 12. The interlocking gear 14 on the retard roller shaft 5 transmits the driving to the pickup roller 1 by the built-in one-way clutch 14*a* (see FIG. 4B), only when the retard roller 3 co-rotates.

In the present embodiment, the retard roller 3 rotates around the retard driving shaft 6 with the state where the distance "a" between the retard roller shaft 5 and the retard driving shaft 6 is constantly held. Therefore, the retard pressure N_f at the normal state is set by the retard pressure N_0, the torque limiter value T, the torque-limiter-gear-pitch circle radius "b" of the retard roller shaft 5 side, and the distance "a" between the retard roller shaft 5 and the retard driving shaft 6 without the distance "L" or "1" in the first and second embodiments.

Similarly, since the distances "L", "1", and "ls" in the first and second embodiments are not presented, the retard pressure N_x at the interlocking state is set as follows. That is, the retard pressure N_x is set by the load Ts of the pickup roller which is transmitted through the interlock driving gear train 15, the torque-limiter-gear-pitch circle radius "bs (b_s)" of the retard roller shaft 5 side, and the distance "a" between the retard roller shaft 5 and the retard driving shaft 6, in addition to the retard pressure N_f.

Even in the above configuration, the retard pressure N_x at the interlocking state may be a value which satisfies the relation of F_1<μN_x. As in the first and second embodiments, when the retard biting angle is denoted as "θ", the retard pressure N_x at the interlocking state, the retard pressure N_f at the normal state, and the retard pressure N_R at the separation operation state may be represented by the following Expressions (4), (5), and (6).

[Expression 4]

$$N_X = \left(-\frac{1}{r\tan\theta} + \frac{1}{b\sin\theta}\right)\left(\frac{a-b}{b}\right)T + N_0 + \left(-\frac{1}{r\tan\theta} + \frac{1}{b_s L\sin\theta}\right)\left(\frac{a-b_s}{b_s}\right)T_s \tag{4}$$

[Expression 5]

$$N_f = \left(-\frac{1}{r\tan\theta} + \frac{1}{b\sin\theta}\right)\left(\frac{a-b}{b}\right)T + N_0 \tag{5}$$

[Expression 6]

$$N_R = \frac{N_0}{1-\left(-\frac{1}{\tan\theta} + \frac{r}{b\sin\theta}\right)\mu} \tag{6}$$

The present embodiment described above can obtain the same effects as in the first embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-242698, filed Nov. 2, 2012, which is hereby incorporated by reference herein in its entirety.

What is claimed is:

1. A sheet feeding apparatus comprising:

a sheet stacking portion on which a sheet is stacked;

a feeding roller which feeds the sheet stacked on the sheet stacking portion in a sheet feeding direction;

a pair of separation rollers which includes a conveyance roller which conveys the sheet fed by the feeding roller and a separation roller which is provided to be capable of being pressed against the conveyance roller and to which is applied a rotation force to return the sheet in a direction opposite to the sheet feeding direction through a torque limiter;

a rotation transmitting portion which transmits a rotation of the separation roller, when the separation roller is co-rotated by the sheet separated by the pair of separation rollers, to the feeding roller; and a separation pressure changing portion to which a load applied to the feeding roller from the sheet is transmitted through the rotation transmitting portion and increases a separation pressure with which the separation roller is pressed against the conveyance roller, when a co-rotation of the separation roller is transmitted to the feeding roller by the rotation transmitting portion.

2. The sheet feeding apparatus according to claim 1, wherein the separation pressure changing portion changes a separation pressure at an interlocking state where the feeding roller rotates in the sheet feeding direction by the co-rotation of the separation roller transmitted by the rotation transmitting portion so as to be higher than a separation pressure at a separation state where one sheet of plural sheets entered a separation nip portion between the conveyance roller and the separation roller is fed in the sheet feeding direction by the conveyance roller and another sheet is returned to a direction opposite to the sheet feeding direction by the separation roller.

3. The sheet feeding apparatus according to claim 2, wherein when a sheet feeding speed of the separation roller at the interlocking state is denoted as Vc, a sheet feeding speed of the feeding roller at the interlocking state is denoted as Va, a distance between a sheet contact position of the feeding roller and the separation nip portion is denoted as "L_ab", and a distance between a leading position of the sheet on the sheet stacking portion and the separation nip portion is denoted as "L_eb", the relation is set so as to satisfy a condition of $L_ab / Vc \geq L_eb / Va$.

4. The sheet feeding apparatus according to claim 1, wherein the separation pressure changing portion includes an interruption portion that interrupts a rotation in the direction opposite to the sheet feeding direction of the separation roller so as not to transmit the rotation to the feeding roller at a separation state.

5. The sheet feeding apparatus according to claim 1, wherein the separation roller is swingingly supported using a swing center of a position apart a predetermined distance from a downstream side in the sheet feeding direction from a rotation center of the separation roller, as a fulcrum, and the torque limiter is disposed within a driving transmission path of the separation roller from a driving source that drives the separation roller.

6. The sheet feeding apparatus according to claim 1, wherein the separation roller is supported so as to be capable of swing around a separation roller driving shaft to which a driving is transmitted, and a separation roller shaft provided with the separation roller and the separation roller driving shaft are connected to each other through the torque limiter by a gear so that a driving of the separation roller driving shaft is transmitted to the separation roller through the separation roller shaft.

7. The sheet feeding apparatus according to claim 6, wherein the rotation transmitting portion is configured by a gear train that transmits a rotation to the feeding roller from the separation roller shaft, and the separation pressure changing portion is configured by a gear which is provided in the gear train and provided on the separation roller shaft and a gear which is rotatably provided on the separation roller driving shaft.

8. The sheet feeding apparatus according to claim 1, wherein a sheet conveyance portion is disposed downstream of the separation roller to convey a sheet, when a conveyance of the sheet is started by the sheet conveyance portion, the separation roller is co-rotated with the sheet by a function of the torque limiter, and the rotation transmitting portion transmits the rotation of the separation roller to the feeding roller.

9. An image forming apparatus comprising:

the sheet feeding apparatus according to claim 1; and an image forming portion which forms an image on a sheet fed from the sheet feeding apparatus.

10. A sheet feeding apparatus comprising:

a sheet stacking portion on which a sheet is stacked;

a pickup roller which rotates in a sheet feeding direction to feed the sheet stacked on the sheet stacking portion;

a feed roller which feeds the sheet fed by the pickup roller;

a retard roller to which is applied a rotation force to return the sheet in a direction opposite to the sheet feeding direction through a torque limiter in a state of the retard roller being pressed against the feed roller;

a pair of conveyance rollers which convey a sheet separated by the retard roller;

a rotation transmitting gear train which transmits a rotation of the retard roller, when the retard roller co-rotates with the sheet conveyed by the pair of conveyance rollers, to the pickup roller; and a separation pressure changing gear train which increases a separation pressure with which the retard roller is pressed against the feed roller, when the rotation of the retard roller is transmitted to the pickup roller by the rotation transmitting gear train.

11. The sheet feeding apparatus according to claim 10, wherein a retard roller shaft is swingingly supported to support the retard roller around a retard roller driving shaft for transmitting a driving to the retard roller, and a gear train is provided to transmit a driving force to the retard roller shaft from the retard roller driving shaft to increase the separation pressure with which the retard roller is pressed against the feed roller by a driving force during a driving transmission.

12. The sheet feeding apparatus according to claim 11, wherein the retard roller is pressed against the feed roller by the separation pressure which is increased by the driving force when the driving is transmitted to the retard roller and the separation pressure which is increased by the separation pressure changing gear train.

13. The sheet feeding apparatus according to claim 10, wherein the rotation transmitting gear train includes a plurality of gears that transmits a rotation to a pickup roller shaft, which supports the pickup roller, from a retard roller shaft which supports the retard roller, and the separation pressure changing gear train includes a part of gears of the rotation transmitting gear train.

14. The sheet feeding apparatus according to claim 13, wherein the rotation transmitting gear train is set such that a circumferential speed of the retard roller is higher than that of the pickup roller at an interlocking state and is provided with a one-way mechanism so as not to transmit a driving from the pickup roller to the retard roller.

15. An image forming apparatus comprising:

the sheet feeding apparatus according to claim 10; and an image forming portion which forms an image on a sheet fed from the sheet feeding apparatus.

* * * * *